United States Patent [19]

Hockerson

[11] 4,322,895

[45] Apr. 6, 1982

[54] STABILIZED ATHLETIC SHOE

[76] Inventor: Stan Hockerson, 62 Vallejo St., Petaluma, Calif. 94952

[21] Appl. No.: 101,708

[22] Filed: Dec. 10, 1979

[51] Int. Cl.[3] ..... A43B 5/00; A43B 23/08

[52] U.S. Cl. ..... 36/129; 36/69

[58] Field of Search ..... 36/69, 129, 80

[56] References Cited

U.S. PATENT DOCUMENTS 3,333,353 8/1967 Garcia ..... 36/69

4,180,924 1/1980 Subotnick ..... 36/129

FOREIGN PATENT DOCUMENTS 2420312 10/1979 France ..... 36/69

*Primary Examiner*—Patrick D. Lawson

*Attorney, Agent, or Firm*—Flehr, Hohbach, Test, Albritton & Herbert

[57] ABSTRACT

An athletic shoe having an upper with a counter forming a heel cup carried above a sole having an outsole, midsole and heel wedge. A support band is formed integral about the upper rim of the midsole and is secured about the sidewalls of the heel cup for supporting and stabilizing the heel cup relative to the sole when the shoe contacts the running surface.

3 Claims, 6 Drawing Figures

STABILIZED ATHLETIC SHOE

This invention relates in general to athletic shoes, and in particular relates to running or jogging shoes.

Recent developments in the designs of running shoes have led to relatively light-weight shoes with soles formed of materials selected for optimum cushioning and flexibility and with minimal sole wear. Despite the improvements in shoe designs, many individuals continue to develop injuries which can be traced to foot problems and shortcomings in the design of the shoes they are wearing. Among these problems are Achilles tendonitus caused by physiological defects such as short Achilles and problems such as an unstable heel, inverted heel, weak arch and excessive use of toe flexors; metatarsal stress fracture caused by unstable heel, pronatory abnormalities and forefoot problems; runner's knee caused by conditions such as weak foot, forefoot varus, Morton's foot and pronatory foot influences including an unstable heel.

Among the solutions which have been employed to correct the foregoing problems are the use of orthotics prescribed for a particular individual and which are fitted within the heel cup of a shoe to control pronation throughout heel and forefoot contact during the gait cycle. Certain shoes have been designed which incorporate a varus wedge which operate in a similar manner to orthotics for control of foot pronation. Certain designs also incorporate a flared sole construction resulting in a pyramid-shaped midsole which has the objective of providing more stability to the shoe during rear foot impact.

FIGS. 1 and 2 illustrate prior art shoe designs of the type having pyramid-shaped midsoles. In these designs the sides of the heel cup project over the upper rims of the midsole. During the running cycle the shoe at the time of heel impact is in the normal supinated position, as illustrated in FIG. 2 when viewed from behind for the shoe on the right foot of an individual. The maximum shock or g forces are absorbed by the sole and heel portions during the initial phase of heel contact, and these forces in conventional shoes compress the outer rim of the sole which tends to collapse or flex relative to the heel cup due to the structural weakness at the juncture between the midsole and heel cup at the zone indicated by the arrows in FIG. 2. The result is a lack of support for the heel cup with consequent loss of stability and control for the runner's heel. If the runner has a tendency to supinate or pronate, then the shoe will not be supportive. Since the feet of most runners strike the surface in a supinated position and tend to pronate as they continue through the foot-strike cycle, conventional shoes of the type shown in FIGS. 1 and 2 do not provide adequate support, and the heel cup tends to collapse.

Certain recent shoe designs have attempted to alleviate the foregoing problems by widening the upper portions of the midsole. These attempts, however, have not achieved complete success for a number of reasons. One problem is that materials used in making the midsole have a tendency to break down. When orthotics of the resin type are put into the shoes they have a tendency to break down the plastic heel counter. Also, when a running shoe is resoled the midsole is usually broken down along with the heel cup. A breakdown of the midsole or collapse of the heel cup can set up a condition in which supination and pronation can be a range of much wider than the normal 6°-8° of total motion, which in turn could produce serious injuries to the runner.

It is an object of the present invention to provide a new and improved athletic shoe which achieves more complete stability throughout the gait cycle.

Another object is to provide an athletic shoe which stabilizes the heel cup and puts the foot in a more stable position to allow the muscles in the legs and feet to be in the correct position for proper shock absorption.

Another object is to provide an athletic shoe of the type described which permits the use of orthotics while minimizing breakdown of the heel counter.

Another object is to provide an athletic shoe of the type described which minimizes the chance of the heel cup displacing from the base of the sole.

Another object is to provide an athletic shoe of the type described having a more stable heel cup without loss of shock absorption qualities, flexibility or sole wear.

The invention in summary comprises an athletic shoe having an upper secured to a sole having midsole and outsole portions. The upper has a counter formed with a heel cup. A support band is carried on the upper rim of the midsole and the band is secured about the sidewalls of the heel cup. The band extends upwardly to the midspan of the heel cup for supporting and stabilizing the heel cup relative to the sole.

The foregoing and additional objects and features of the invention will appear from the following specification in which the embodiments have been set forth in detal in conjunction with the accompanying drawings.

Figure 1:
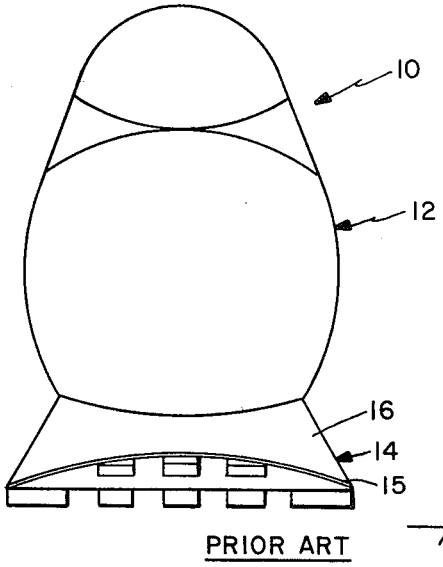
FIG. 1 is a rear elevational view of a prior art athletic shoe shown in a position prior to contact with a surface during the gait cycle.
Figure 2:
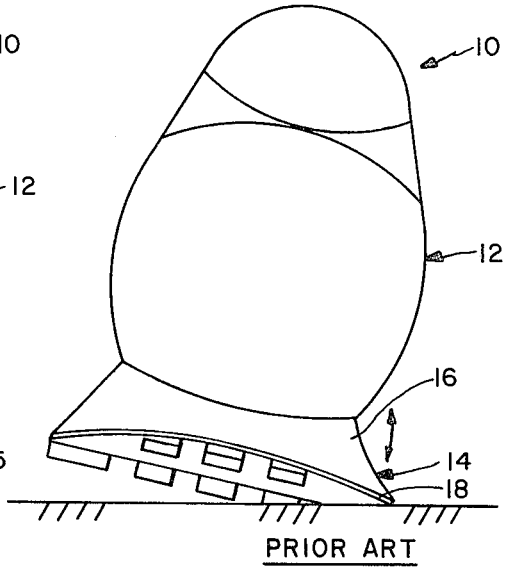
FIG. 2 is a view of the prior art shoe similar to FIG. 1 shown in a position following initial heel contact with the surface.

In the drawings FIGS. 1 and 2 illustrate generally at 10 a prior art athletic shoe having an upper 12 mounted above a sole 14. The sole has a pyramid-shaped midsole 16 which is characterized in having an outwardly flared lower rim 15. The purpose of the outwardly flared rim is to provide more stability for the runner during initial heel contact with the surface. FIGS. 1 and 2 illustrate a rear view of the right shoe worn by an individual. During the gait cycle just prior to heel contact, the right foot and shoe of the individual would be in a normal supinated position as shown in FIG. 2. At the time of initial heel contact in the supinated position the outisde edge 18 of the sole is compressed in the manner of FIG. 2 as the impact force begins to be absorbed by the sole and is carried up through the shoe to the foot. The weight of the individual pressing down along the line above the point of impact creates a pressure which tends to collapse the heel cup because of the lack of support from the sole. The same condition and result occurs for the runner's left shoe (not shown) when it strikes the surface.

FIGS. 3–6 illustrate an athletic shoe 20 incorporating the present invention. The shoe includes an upper 22 having a counter 24 which forms a heel cup 26. The upper is mounted above forefoot and heel portions of a sole 28 comprised of an outsole 30, midsole 32 and heel wedge 34. The heel wedge could also be integral with the midsole, or the outsole could be integral with the heel wedge and midsole, as desired. An insole 36 can be provided on the inside of upper above the sole, also as desired.

The elements of sole 28 are formed of suitable synthetic polymer materials having properties of durability, flexibility and resiliency for cushioning the foot during contact with the surface. A support band 38, preferably formed integral with the upper rim of the midsole, is secured about the sidewalls of heel cup 26. The support band and sole can be secured to the upper by suitable adhesives or stitching, or a combination thereof. The support band extends upwardly to merge along the line 40 with the vertical midspan of the heel cup and also extends upwardly to merge along the line 42 with the sides of the upper which are above the rear portion of the forefoot. While an integral support band is illustrated, the band could also be a separate piece which is secured as by fusion to the sole during manufacture.

Figure 3:
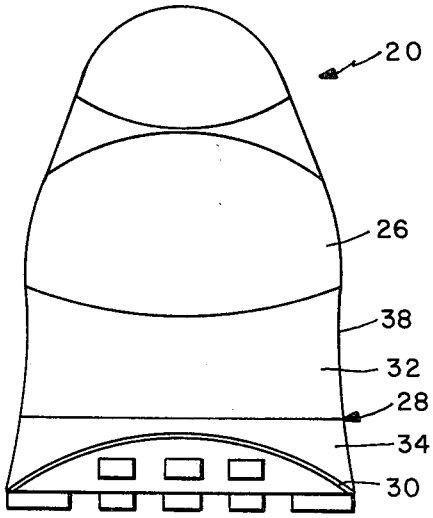
FIG. 3 is a rear elevational view of an athletic shoe constructed in accordance with the invention and shown in a position prior to contact with a surface during the gait cycle.
Figure 4:
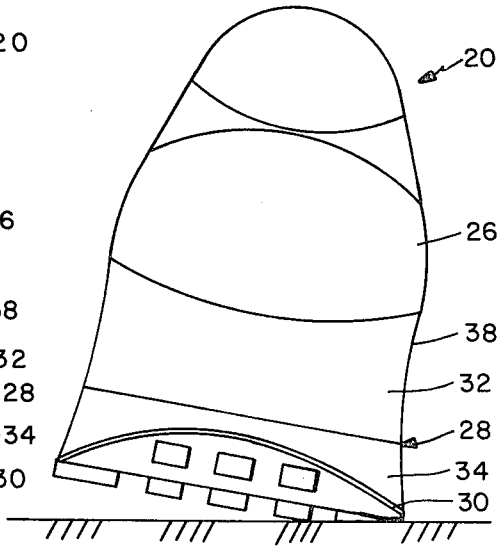
FIG. 4 is a view similar to FIG. 3 showing the shoe in a position following initial contact with the surface.
Figure 5:
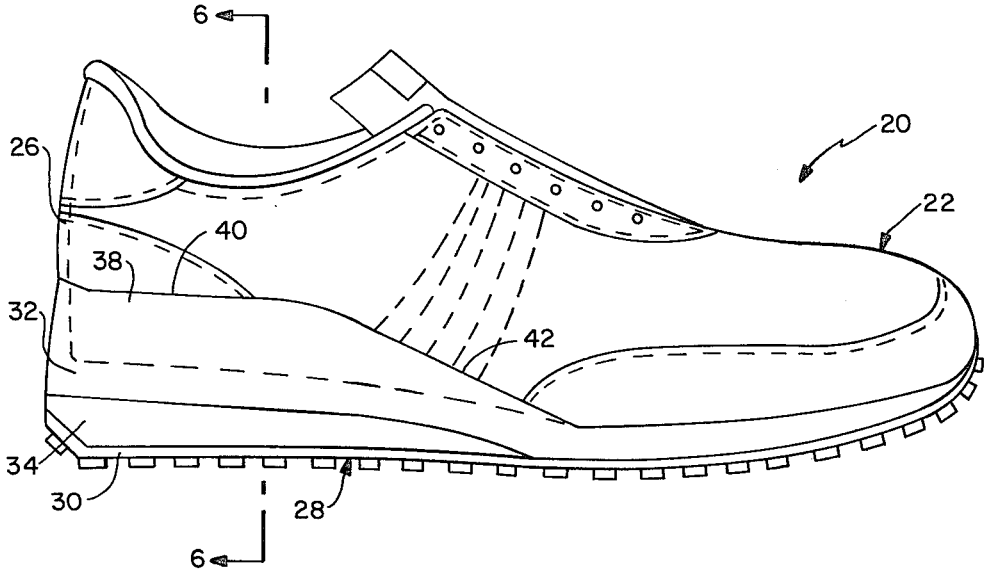
FIG. 5 is a side elevational view of the shoe of FIGS. 3 and 4.
Figure 6:
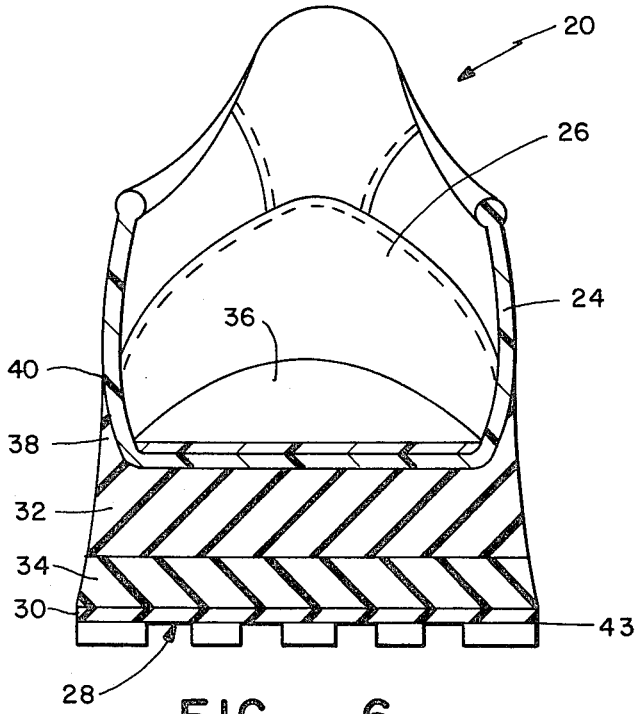
FIG. 6 is a cross-sectional view taken along the line 6—6 of FIG. 5.

In the present embodiment the opposite sides of the lower rim 43 of the heel portion have a lateral width greater than the lateral width of the heel cup midspan. As best illustrated in FIGS. 3, 4 and 6, the midsole 32 and support band 38 form a structure having substantially straight walls inclining between the vertical midspan of the heel cup and lower rim of the sole. During heel contact with the surface as illustrated in FIG. 4, the sole construction of the invention stabilizes the heel cup and resists flexing of the side of the heel cup relative to the sole. As a result the runner's foot is in a more stable position so that the muscles of the legs and feet are in the proper position for shock absorption. Furthermore, when the runner uses an orthotic (not shown) inserted into the shoe, the additional support provided by the invention minimizes breakdown of the heel counter as well as breakdown of the midsole. The additional heel support and stability is provided by the invention without loss of shock absorption qualities, flexibility or sole wear. Because the problem of breakdown of the midsole and collapse of the heel cup is obviated, proper motion control is attained throughout supination and pronation during the running cycle.

While the foregoing embodiments are at present considered to be preferred, it is understood that numerous variations and modificatons may be made therein by those skilled in the art and it is intended to cover in the appended claims all such variations and modificaions as fall within the true spirit and scope of the invention.

What is claimed is:

1. An Athletic Shoe comprising a sole having a midsole with a forefoot and heel portions, an upper mounted on the sole, the upper having a counter forming a heel cup having exterior sidewalls, a support band carried on the upper rim of the midsole and secured about the sidewalls of the heel cup, said band extending upwardly and merging with the vertical midspan of the heel cup for supporting and stabilizing the heel cup relative to the sole during contact of the sole onto a surface when in use, the opposite sides of the lower rim of the heel portion having a lateral width greater than the lateral width of the heel cup midspan, and the support band inclines upwardly from the lower rim of the heel portion to the heel cup midspan for resisting flexing of the side of heel cup relative to the sole during initial contact on the surface along one side of the sole.

2. An athletic shoe as in claim 1 in which the support band extends forward from the heel cup and merges with the opposite sides of the upper above the midsole for providing support between said opposite sides and the midsole.

3. An athletic shoe as in claim 2 in which the support band is integral with the midsole.

* * * * *

UNITED STATES PATENT AND TRADEMARK OFFICE

CERTIFICATE OF CORRECTION

PATENT NO. : B1 4,322,895

DATED : August 8, 1995

INVENTOR(S) : Stan Hockerson

It is certified that error appears in the above-indentified patent and that said Letters Patent is hereby corrected as shown below:

Title page, in the paragraph "Notice: The portion of the term..." delete "April 6, 1998" and substitute --July 27, 1999--.

Signed and Sealed this

Ninth Day of July, 1996

*Attest:*

*Attesting Officer*

BRUCE LEHMAN

*Commissioner of Patents and Trademarks*

US004322895B1

REEXAMINATION CERTIFICATE (2645th)

United States Patent [19]

Hockerson

[11] B1 4,322,895

[45] Certificate Issued * Aug. 8, 1995

[54] STABILIZED ATHLETIC SHOE

[76] Inventor: Stan Hockerson, 62 Vallejo St., Petaluma, Calif. 94952

Reexamination Request:
No. 90/002,657, Mar. 2, 1992

Reexamination Certificate for:

| | |
|---|---|
| Patent No.: | **4,322,895** |
| Issued: | **Apr. 6, 1982** |
| Appl. No.: | **101,708** |
| Filed: | **Dec. 10, 1979** |

[ * ] Notice: The portion of the term of this patent subsequent to Apr. 6, 1998 has been disclaimed.

[51] Int. Cl.[6] ..... A43B 5/00; A43B 23/08
[52] U.S. Cl. ..... 36/129; 36/69
[58] Field of Search ..... 36/68, 69, 28, 35 R, 36/80, 88, 89, 92, 114, 25 R, 103, 30 R, 129, 32 R, 81, 7.3, 31, 37

[56] References Cited

U.S. PATENT DOCUMENTS

| | | | |
|---|---|---|---|
| 2,071,431 | 2/1937 | Riddell . | |
| 2,403,442 | 7/1946 | Klaus . | |
| 3,100,354 | 8/1963 | Lombard et al. | 36/32 R |
| 3,824,716 | 7/1974 | DiPaolo . | |
| 3,834,046 | 9/1974 | Fowler . | |
| 3,852,895 | 12/1974 | Funck . | |
| 3,952,358 | 4/1976 | Fukuoka | 12/142 MC |
| 3,964,181 | 6/1976 | Holcombe, Jr. . | |
| 4,090,831 | 6/1978 | Hujik . | |
| 4,150,455 | 4/1979 | Fukuoka . | |
| 4,202,117 | 6/1980 | Bidegain . | |
| 4,255,877 | 3/1981 | Bowerman . | |
| 4,259,792 | 4/1981 | Halberstadt . | |
| 4,322,895 | 4/1982 | Hockerson . | |

FOREIGN PATENT DOCUMENTS

| | | |
|---|---|---|
| 1916754 | 4/1969 | Germany . |
| 2556612 | 12/1975 | Germany . |
| 24-59744 | 5/1949 | Japan . |
| 33-19235 | 11/1958 | Japan . |
| 35-19933 | 8/1960 | Japan . |
| 35-22826 | 9/1960 | Japan . |
| 38-11303 | 6/1963 | Japan . |

*Primary Examiner*—Thomas P. Hilliard

[57] ABSTRACT

An athletic shoe having an upper with a counter forming a heel cup carried above a sole having an outsole, midsole and heel wedge. A support band is formed integral about the upper rim of the midsole and is secured about the sidewalls of the heel cup for supporting and stabilizing the heel cup relative to the sole when the shoe contacts the running surface.

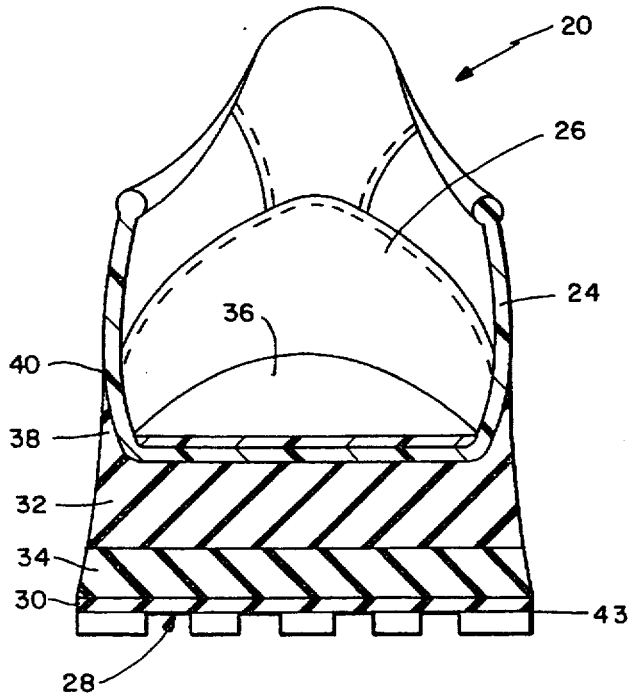

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 3: *The heel cup has exterior sidewalls with lower edges.*

Column 3, lines 10–11. *The heel portion is pyramid shaped in lateral cross section with a lower rim having opposite side which flare outwardly. The lateral sides of the pyramid are not shown in the cross section of FIG. 6 because in the preferred embodiment they merge with the support band.*

AS A RESULT OF REEXAMINATION, IT HAS BEEN DETERMINED THAT:

Claim 1 is determined to be patentable as amended.

Claims 2 and 3 dependent on an amended claim, are determined to be patentable.

1. An Athletic Shoe comprising a sole having a midsole [with a forefoot and heel portions] *formed of a resilient force-absorbing material,*

*an outsole mounted below the midsole, said outsole being formed of a durable material for contact with a surface,* an upper mounted on the sole, the upper having a counter forming a heel cup having exterior sidewalls *with lower edges,* a support band carried on the upper rim of the midsole and secured about the sidewalls of the heel cup, said band extending upwardly and merging with the vertical midspan of the heel cup for supporting and stabilizing the heel cup relative to the sole during contact of the sole onto the surface when in use,

*said midsole comprising a forefoot portion and heel portion means, said heel portion means being pyramid shaped in lateral cross section with a lower rim having opposite sides which flare outwardly to locations which lie sufficiently laterally beyond the lower edges of the heel cup for substantially stabilizing the shoe during initial contact on the surface along one side of the sole,* the opposite sides of the lower rim of the heel portion *means* having a lateral width greater than the lateral width of the heel cup midspan, and the *midsole and* support band *having wall means* which inclines upwardly from the lower rim of the heel portion *means* to the heel cup midspan for resisting flexing of the [side] *sidewalls* of *the* heel cup relative to the sole during said initial contact on the surface along one side of the sole.

* * * * *